United States Patent [19]

Genakis

[11] 4,068,509

[45] Jan. 17, 1978

[54] PIN TUMBLER LOCK CYLINDER

[75] Inventor: Joseph M. Genakis, Worcester, Mass.

[73] Assignee: Benjamin D. Pollack, Morris, Conn.

[21] Appl. No.: 706,935

[22] Filed: July 19, 1976

Related U.S. Application Data

[63] Continuation of Ser. No. 579,040, May 19, 1975, abandoned.

[51] Int. Cl.[2] ..... E05B 27/04

[52] U.S. Cl. ..... 70/364 A; 70/373; 70/375; 70/419

[58] Field of Search ..... 70/364 A, 373, 375, 70/378, 419, 421, 455

[56] References Cited

U.S. PATENT DOCUMENTS

| | | | |
|---|---|---|---|
| 830,013 | 9/1906 | Shaw | 70/340 |
| 899,955 | 9/1908 | Collins | 70/373 |
| 1,044,186 | 11/1912 | Kimball | 70/373 X |
| 1,561,229 | 11/1925 | Fremon | 70/340 X |
| 3,885,409 | 5/1975 | Genakis | 70/364 A |

*Primary Examiner*—Robert L. Wolfe
*Attorney, Agent, or Firm*—John E. Toupal

[57] ABSTRACT

A cylinder lock comprising a plug, with an eccentric face, a cylinder and an eccentric sleeve between the plug and cylinder. When a proper key is inserted and raises the pins to operating shear level the plug and sleeve can be turned as a unit on an axis to unlock or lock, but in the event there is a single pin restraining the rotary motion of the sleeve, only a limited plug motion is permitted as it is now in an eccentric relation with respect to the cylinder. Picking of the lock is prevented by dividing the sleeve into segments rotatable with respect to each other and providing each with circumferentially extending recesses in which tumbler pins can become ledged.

15 Claims, 21 Drawing Figures

PIN TUMBLER LOCK CYLINDER

RELATED APPLICATIONS

This application is a continuation of application Ser. No. 579,040, filed May 19, 1975 and now abandoned.

BACKGROUND OF THE INVENTION

Attention is directed to co-pending application Ser. No. 457,586, filed Apr. 3, 1974, and U.S. Pat. No. 3,885,409 dated May 27, 1975.

Continuing attempts are being made to try to produce pin tumbler locks that are actually pick proof. Much has been done in this matter and the above-mentioned patent and pending application are referred to in this connection. However, it is found that the pins in pin tumbler locks may be picked in some cases or may be sheared by a strong tool inserted into a keyway. It is the general object of the present invention to provide a pin tumbler lock which is extremely difficult to be picked and which is exceptionally strong.

SUMMARY OF THE INVENTION

A pin tumbler lock includes a cylinder housing with a circular bore in which a cylindrical plug is eccentrically mounted. On the plug there are mounted sleeve segments each having at least one pinway. The construction is such that the parts are arranged such that the plug and sleeve segments form a concentric unit that when a proper key is utilized can be rotated on an axis to open or close the lock. However in the event even one pin is still not aligned with respect to the proper shear level and restrains a sleeve segment, the plug may be turned only a very small amount on an eccentric axis so that the plug quickly binds to prevent opening of the lock. Picking of the lock is prevented by the provision in each sleeve segment of circumferentially extending recesses coincident with the pinways. During a picking attempt the pins become ledged in the recesses and relative rotational movement between sleeve segments produces pinway misalignment that prohibits further attempts to attain the proper shear. Mounted eccentrically on the plug is a circular face that is retained in a concentric face opening in the cylinder. Binding occurs between the plug face and cylinder opening in response to independent rotation of the plug. This feature prevents opening of the lock in the event a false shear line is attained at the junction between the plug and sleeve segments. The rings and bands make up a sleeve length.

In addition, a diagonally contoured movable plate may be utilized in a longitudinal recess in an extra eccentric sleeve arrangement mounted on the plug. This sleeve has longitudinal grooves or recesses in the outer surface and in the lower surface with corresponding apertured diagonal contoured plates therein.

Also, in addition to this, a third set of bands or rings may be utilized comprising a plurality of parts each of which is cut on a bias relative to the axis thereof so that when the plug is attempted to be turned with one or more pins restraining the rings or bands, there is dislocation of the pinways in addition to the binding at the face of the plug and the face of the cylinder, there is also binding between the various inclined edges of the various parts of the third level rings or bands.

PREFERRED EMBODIMENTS OF THE INVENTION

Figure 4:
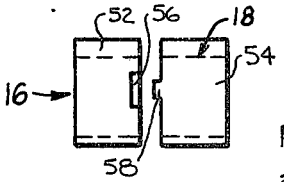
FIG. 4 is a detail illustrating interengaging means between the various rings or bands going to make up a sleeve.

A cylinder housing 10 has a plug 12 eccentrically positioned in a circularly cylindrical bore 11. The plug 12 defines a conventional key slot 14 therein. Surrounding the plug there are a plurality of sleeves 16, 20, 32 forming a composite circularly cylindrical sleeve rotatably mounted in the bore 11. The plug 12 is rotatably mounted in a circularly cylindrical passage 19 defined by the inner sleeve 16 and eccentric to the axis of the bore 11. Forming the sleeve 16 are a plurality of ring segments 54, two of which are shown in FIG. 4. The segments 54 are interengaged by recesses 56 and tabs 58 that permit relative rotational movement therebetween. It will be noted that the segments are eccentric in that they are thinner at one edge and gradually thicken to a maximum diametrically opposite. There is also a groove or recess 52 in the thickest portion of each forming a composite elongated recess which is indicated at 18. The plug is correspondingly but reversely eccentric relative to its circular face 40, as will be described.

If desired, a second set of rings or bands may be used, or in its place a sleeve 20 may be utilized about the rings or bands 16 and this is also eccentrically made as described previously and has two longitudinal contoured recesses, one exterior thereof as at 22 and one on the interior 24. This forms a contoured floor 26 separating the recesses in each of which is a contoured diagonal apertured plate 28, 30, which lie diagonally in the groove or recess 22 and 24 but assume a rectangular form when pressured out of alignment by the recessed shoulder of the sleeve.

Also, if desired, a third set of rings or bands 32 may be applied to the exterior of sleeve 20 and they also are eccentric and have longitudinal recesses 34. The various rings or bands are arranged to have their thicker sides additive, the plug however being cylindrical with a constant radius.

Figure 2:
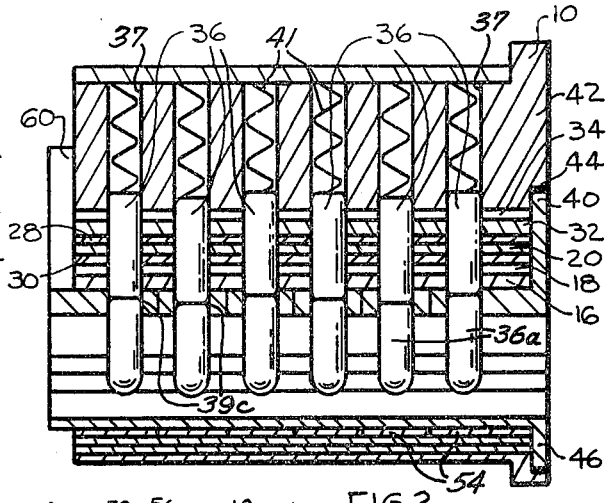
FIG. 2 is a sectional view taken on line 2—2 of FIG. 1.

The cylinder housing 10 of course has housing pinways 37 as shown in FIG. 2 and the sleeves 16, 20 and 32 have aligned sleeve pinways **39, 39*a* and 39*b* as shown in FIGS. 6–12. The pinways retain driver pins 36 biased inwardly by springs 41. Also defined by the plug 12 are plug pinways 39*c* that retain tumbler pins 36*a* longitudinally aligned with the driver pins 36. The circular face 40 of the plug is inserted into a circular opening 44 in the face 42 of the cylinder 10**.

Figure 1:
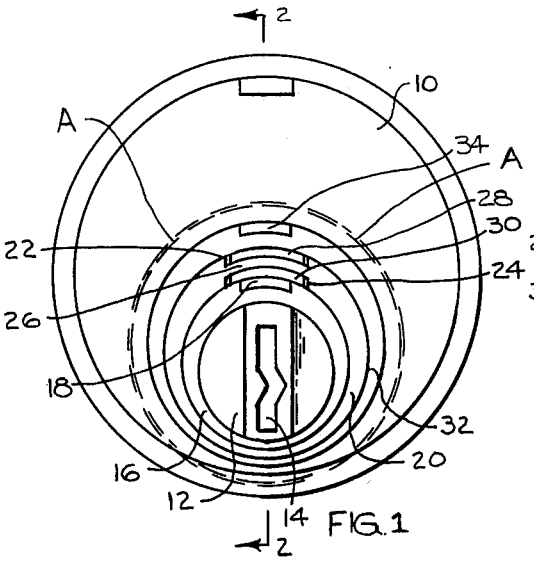
FIG. 1 is a rear view, without cam or other actuator, of the cylinder, plug and three intervening levels of eccentric rings, bands and sleeve.
Figure 3:
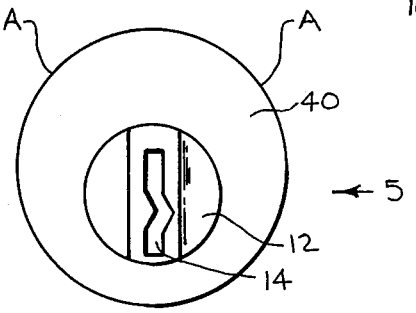
FIG. 3 is a view showing the plug face and potential areas of binding stop.
Figure 5:
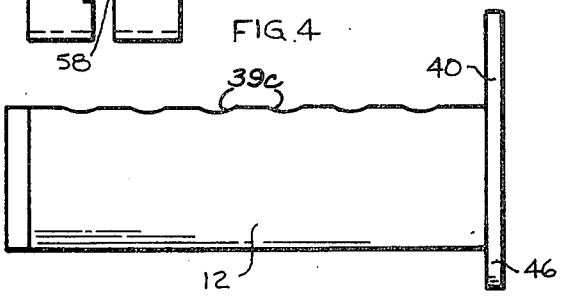
FIG. 5 is a side view of the plug.
Figure 6:
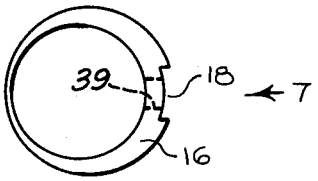
FIG. 6 is an end view of the eccentric ring surrounding the plug.
Figure 7:
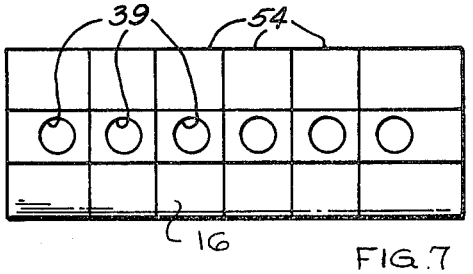
FIG. 7 is a view in elevation looking in the direction of arrow 7 in FIG. 6.
Figure 16:
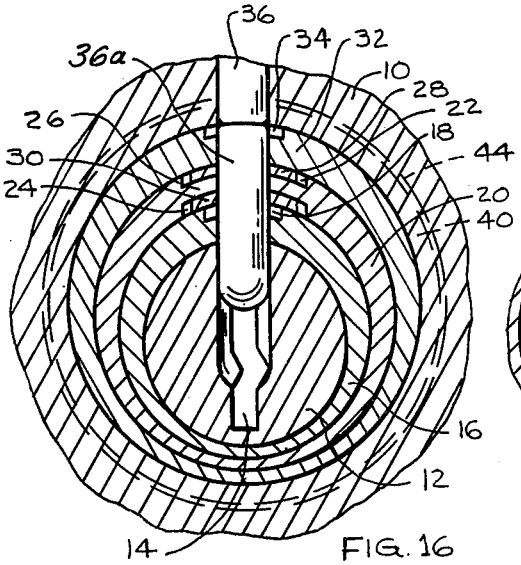
FIG. 16 is a view on an enlarged scale similar to that of FIG. 1 and illustrating the top and bottom pin and the proper shear point level when three intermediate plug surrounding members are utilized.
Figure 15:
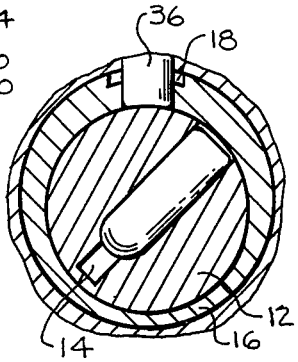
Figure 19:
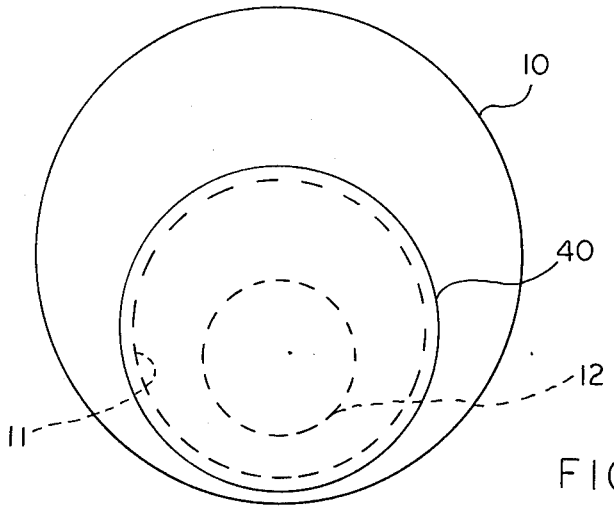
Figure 20:
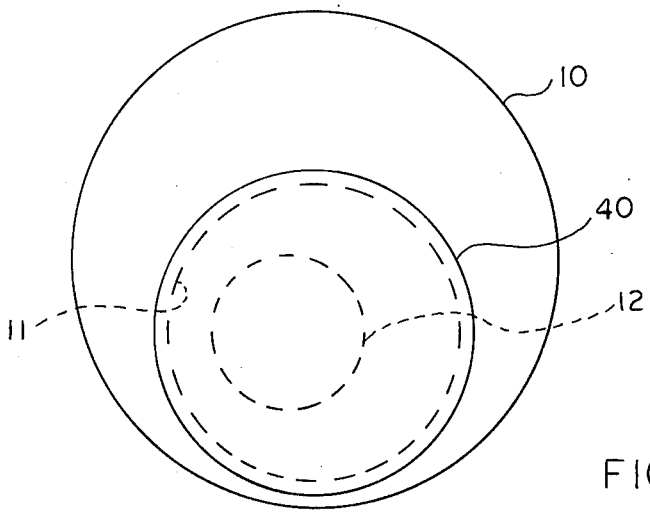
Figure 21:
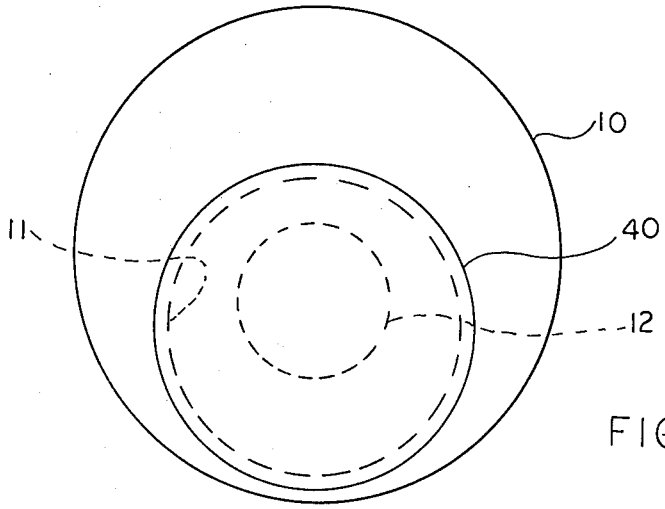

As shown in FIG. 5, the plug face 40 extends upwardly a distance greater than it extends downwardly, see 46, and is eccentric to a central axis running through the plug, but is concentric bore 11 and the plug face opening 44 in the cylinder 10. When a proper key is used in the keyway 14 and all the pins are raised, a shear point will be reached wherein the tumbler pins **36*a* and the driver pins 36 meet along the surface of engagement between the sleeve 32 and the cylinder housing 10 as shown in FIG. 16. In those positions, the tumbler pins 36*a* engage the plug 12 with the sleeves 16, 26 and 32 forming a composite circularly cylindrical unit that is not tied to the housing 10. Consequently, the unit can turn on the common axis of the bore 11 and the face plate 40 to unlock or lock the lock. During such operation of the lock, the eccentric plug 12 moves in an orbital path about the axis of the bore 11 as illustrated by the different plug positions shown in FIGS. 19–21. However, should any of the pins 36 still be engaged between the housing 10 and any of the sleeves, as shown in FIGS. 14, 15, 17 and 18, then the remaining parts of the unit becomes eccentric with respect to the bore 11 and when this happens, and turning is attempted to be forced, binding occurs between the plug 12 and the engaged sleeves preventing rotation. In the event that all of the driver pins 36 are out of the plug pinways 39*c* and torque is applied to the plug 12, the face 40 turns on an eccentric axis relative to the opening 44 in the cylinder, and therefore will bindingly engage on the opening's edge 44 at points A, FIGS. 1 and 3**, and no further turning can be imposed on the plug.

Figure 8:
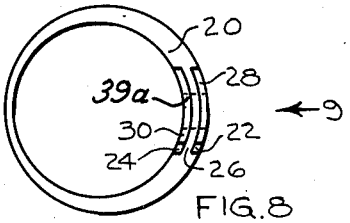
FIG. 8 is an end view of the intermediate sleeve.
Figure 9:
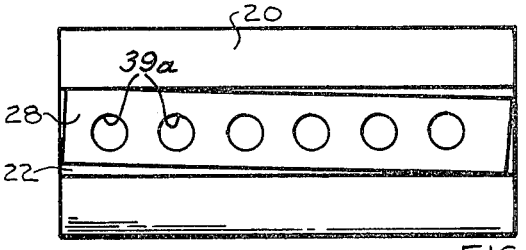
FIG. 9 is a view in elevation looking in the direction of arrow 9 in FIG. 8.
Figure 11:
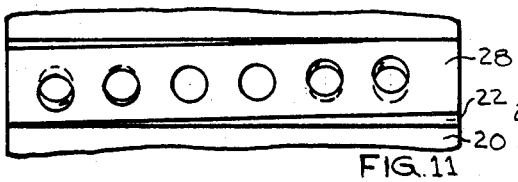
FIG. 11 illustrates diagonal contoured plates assuming an out-of-line form when pressured out of pinway alignment by rotary motion of the plug and longitudinal recess shoulder of sleeve.
Figure 10:
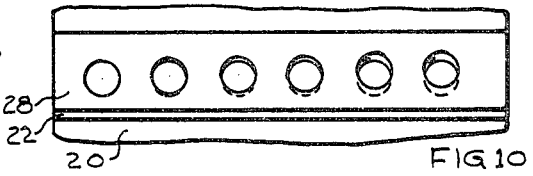
FIG. 10 illustrates the out-of-line position of the diagonal plate or plates utilized with the sleeve of FIG. 8.
Figure 12:
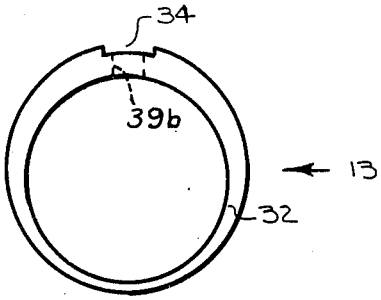
FIG. 12 is a front view of the outermost rings or bands.
Figure 13:
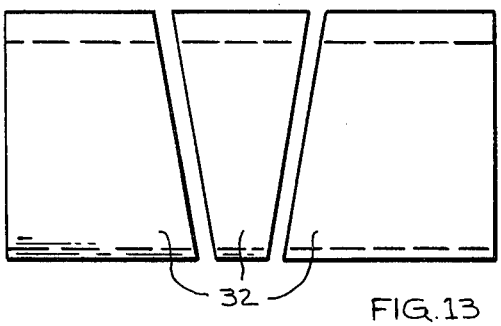
FIG. 13 is an assembly view looking in the direction of arrow 13 in FIG. 12.

Referring now to FIGS. 8, 9 and 10, it will be seen that the plate 28 in the recess 22 of the eccentric sleeve 20 fits snugly in the recess and it is apertured to receive the upper pins 36 shown in FIG. 2. When the plug is attempted to be turned and one or more pins restrain the plate, it will assume a straight longitudinal position in its recess 22 and 24, resulting in a pinway misalignment; see FIG. 10.

Figure 14:
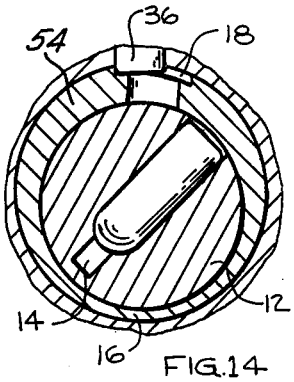
FIGS. 14 and 15 illustrate the action of the plug with the first ring on the plug in false opening positions.
Figure 17:
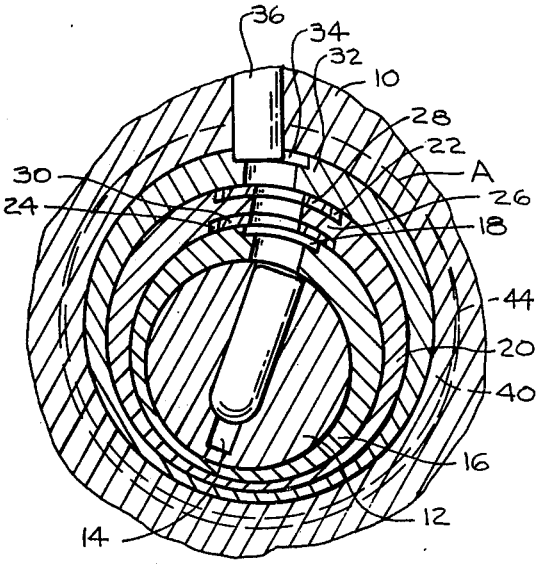
FIGS. 17 and 18 illustrate the action of the structure shown in FIG. 16 in inoperable position showing different positions of the pin restraint of rings, bands and sleeves and, FIGS. 19–21 are front views of the lock illustrating orbital movement of the plug within the cylinder.
Figure 18:
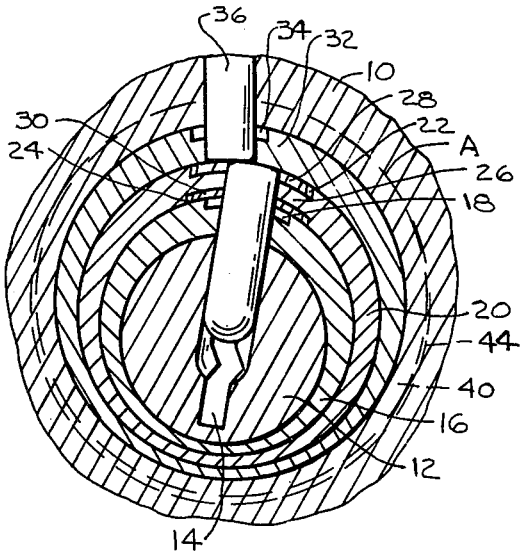

FIG. 14 illustrates the ledging and lodging of a top pin 36 in recess 18 of one segment 54 of the sleeve 16. Similar positions are illustrated in FIGS. 17 and 18 as to the ledging and lodging action where the rings or bands 20 and 32 are utilized in the structure. These represent typical positions that the driver pins 36 would assume during attempts to pick the lock. For example, in accordance with known techniques, a picker would sequentially apply upward pressure on each tumbler pin **36*a* while simultaneously exerting torque on the plug 12 in an attempt to ledge the associated driver pin 36 at shear level. However, before reaching actual shear level, the driver pins 36 would first reach false shear levels provided, for example, by the recess 18 as shown in FIG. 14. In these positions concentric rotation of the composite plug and sleeve unit is prevented and opening of the lock is precluded. Consequently, after all driver pins 36 have reached the positions illustrated in FIG. 14, further picking is required to raise them to the actual shear positions. Such further picking is precluded, however, because the amount of plug movement required to ledge all the driver pins 36 as shown in FIG. 14 will produce a misalignment between the plug pinways 39*c* and one or more of the sleeve pinways 39. The misalignment results from the relative rotational movement that is possible between the individual segments 54 of the sleeve 16. Once misalignment of pinways 39 and 39*c* occurs, the associated tumbler pin 36*a* which will have dropped back into the plug 12 after picking pressure was released cannot be brought into contact with its driver pin 36 and further picking operations are precluded. It will be obvious that attempts to ledge the driver pins 36 at other false shear levels such as those illustrated in FIGS. 17 and 18** will produce a similar result to prevent further picking.

Obviously, many modifications and variations of the present invention are possible in light of the above teachings. For example, it will be obvious that the lock could be modified to eliminate the outer sleeves 20 and 32 and the inner segmented sleeve 16 would still function to subvert picking operations. It is to be understood, therefore, that the invention can be practiced otherwise than as specifically described.

What is claimed is:

1. A cylinder lock comprising:

a lock housing defining a circularly cylindrical bore and a plurality of housing tumbler-ways;

a circularly cylindrical sleeve means rotatably mounted in said bore and having a circularly cylindrical passage with a central axis eccentric to the axis of said bore, said sleeve means defining a plurality of sleeve tumbler-ways aligned with said housing tumbler-ways;

a cylindrical plug rotatably mounted in said passage and defining a longitudinally extending keyway, said plug further defining a plurality of transversely extending plug tumbler-ways intersecting said keyway and aligned with said sleeve tumbler-ways;

a plurality of stacked tumblers longitudinally movable within each set of said aligned housing, sleeve and plug tumbler-ways;

bias means forcing said stacked tumblers toward said keyway; and coupling means substantially preventing rotation of said plug within said passage so as to limit lock opening movement of said plug to an orbital path about the axis of said bore.

2. A cylinder lock according to claim 1 wherein said sleeve means comprises outer walls that define recessed surfaces penetrated by said sleeve tumbler-ways and extending circumferentially therefrom so as to provide ledging surfaces for said tumblers.

3. A cylinder lock according to claim 2 wherein said sleeve means comprise a plurality of axially aligned sleeve segments rotatable with respect to each other, each of said sleeve segments defining at least one of said sleeve tumbler-ways.

4. A cylinder lock according to claim 3 wherein said tumblers are pins.

5. A cylinder lock according to claim 3 wherein said coupling means comprises a circular opening defined by said housing and concentric with said bore, and retainer means secured to said plug and retained in said opening, said retainer having surfaces comforming to the circumference of said opening so as to guide rotational movement of said retainer about the axis of said bore.

6. A cylinder lock according to claim 5 wherein said retainer means comprises a circular plate having a diameter equal to that of said opening and secured to an end of said plug that defines the entrance of said keyway.

7. A cylinder lock according to claim 6 wherein the diameters of said plate and said opening are larger than the diameter of said bore.

8. A cylinder lock according to claim 7 wherein said tumblers are pins.

9. A cylinder lock according to claim 1 wherein said sleeve means comprises a plurality of radially nested individual sleeves rotatable with respect to each other and having radially aligned holes that establish said sleeve tumbler-ways.

10. A cylinder lock according to claim 9 wherein one of said individual sleeves comprises a plurality of axially aligned sleeve segments rotatable with respect to each other, each of said sleeve segments defining at least one of said sleeve tumbler-ways.

11. A cylinder lock according to claim 10 wherein said one sleeve comprises outer walls that define recessed surfaces penetrated by said sleeve tumbler-ways and extending circumferentially therefrom so as to provide ledging surfaces for said tumblers.

12. A cylinder lock according to claim 11 wherein another of said individual sleeves comprises a longitudinal recess that is penetrated by said holes, and including a plate disposed in said longitudinal recess and having plate openings alignable with said holes, said plate being laterally movable in said longitudinal recess so as to produce misalignment between said plate openings and said holes.

13. A cylinder lock comprising:

a lock housing defining a circularly cylindrical bore and a plurality of housing tumbler-ways;

a circularly cylindrical sleeve means rotatably mounted in said bore and having a circularly cylindrical passage with a central axis eccentric to the axis of said bore, said sleeve means comprising a plurality of axially aligned sleeve segments rotatable with respect to each other, each of said segments defining at least one sleeve tumbler-way aligned with one of said housing tumbler-ways;

a cylindrical plug rotatably mounted in said passage and defining a longitudinally extending keyway, said plug further defining a plurality of transversely extending plug tumbler-ways intersecting said keyway and aligned with said sleeve tumbler-ways;

a plurality of stacked tumblers longitudinally movable within each set of said aligned housing, sleeve and plug tumbler-ways; and bias means forcing said stacked tumblers toward said keyway.

14. A cylinder lock according to claim 13 wherein said sleeve means comprises outer walls that define recessed surfaces penetrated by said sleeve tumbler-ways and extending circumferentially therefrom so as to provide ledging surfaces for said tumblers.

15. A cylinder lock according to claim 13 including eccentric coupling means substantially preventing rotation of said plug within said passage so as to limit lock opening movement of said plug to an orbital path about the axis of said bore.

* * * * *